US012453446B1

(12) United States Patent
Crouse et al.

(10) Patent No.: US 12,453,446 B1
(45) Date of Patent: Oct. 28, 2025

(54) APPARATUS FOR CONCEALED SHEET MATERIAL ROLL DISPENSING

(71) Applicants: Henry H. Crouse, Chesterland, OH (US); Maureen O'Connor, Chesterland, OH (US)

(72) Inventors: Henry H. Crouse, Chesterland, OH (US); Maureen O'Connor, Chesterland, OH (US)

( * ) Notice: Subject to any disclaimer, the term of this patent is extended or adjusted under 35 U.S.C. 154(b) by 163 days.

(21) Appl. No.: 18/239,290

(22) Filed: Aug. 29, 2023

Related U.S. Application Data

(60) Provisional application No. 63/471,137, filed on Jun. 5, 2023, provisional application No. 63/401,768, filed on Aug. 29, 2022.

(51) Int. Cl.
*A47K 10/38* (2006.01)
*A47K 10/32* (2006.01)
*A47K 10/36* (2006.01)

(52) U.S. Cl.
CPC ..... *A47K 10/3836* (2013.01); *A47K 10/36* (2013.01); *A47K 2010/3233* (2013.01)

(58) Field of Classification Search
CPC ..... A47K 10/3836; A47K 2010/3233
USPC ..... 242/597, 597.2, 597.5, 597.8
See application file for complete search history.

(56) References Cited

U.S. PATENT DOCUMENTS

| | | | | | |
|---|---|---|---|---|---|
| 2,576,526 | A * | 11/1951 | Marchand | A47K 10/22 | 220/477 |
| 3,266,742 | A * | 8/1966 | Pena | A47K 10/3836 | 242/560.3 |
| 4,936,452 | A * | 6/1990 | Pauley | A47K 10/3827 | 225/84 |
| 5,845,870 | A * | 12/1998 | Angle | A47K 10/38 | 242/598.5 |
| 5,901,921 | A * | 5/1999 | Perlsweig | A47K 10/3836 | 242/597 |
| 6,315,237 | B1 * | 11/2001 | Hoerner | A47K 10/38 | 242/598.5 |
| 11,596,276 | B2 * | 3/2023 | Palutis | A47B 67/02 | |
| 2005/0051663 | A1 * | 3/2005 | Walters | A47K 10/38 | 242/597.8 |
| 2006/0102508 | A1 * | 5/2006 | Decristofaro | A47K 10/185 | 206/494 |
| 2014/0131506 | A1 * | 5/2014 | Clarkin | A47K 3/281 | 242/598.6 |
| 2017/0027395 | A1 * | 2/2017 | Prior | A47K 10/3836 | |
| 2017/0202410 | A1 * | 7/2017 | Epperley | A47K 10/426 | |

* cited by examiner

*Primary Examiner* — William A. Rivera
(74) *Attorney, Agent, or Firm* — Lippes Mathias LLP

(57) ABSTRACT

An apparatus for concealed dispensing of rolled sheet type material includes a body having a faceplate that can be flush mounted on an associated planar mounting surface. The faceplate has an elongated slot that received sheet material therethrough. A roll of the sheet material is received on an L-shaped mounting member, forming a spindle configured to receive the roll thereon.

14 Claims, 13 Drawing Sheets

APPARATUS FOR CONCEALED SHEET MATERIAL ROLL DISPENSING

BACKGROUND

This application is related to and expressly incorporates herein by reference U.S. provisional application Ser. No. 63/401,768, filed Aug. 29, 2022, and U.S. provisional application Ser. No. 63/471,137, filed Jun. 5, 2023.

The present application relates to sheet material dispensing, and more specifically paper sheet roll dispensing. It finds particular application in conjunction with space saving and hidden storage solutions and will be described with particular reference thereto. However, it is to be appreciated that the present exemplary embodiments are also amenable to other like applications.

Paper roll dispensers come in a variety of forms. However, such dispensers are commonly intended to be attached on an exterior surface. These exteriorly mounted dispensers are not typically well designed to be installed in a confined/limited space such as a bathroom, kitchen, or in a confined space (e.g., recreational vehicle, boat, trailer, cabin, cottage, or the like) and more particularly in a concealed, interior area found in the confined space.

Accordingly, a need exists for a concealed paper roll dispensing apparatus that overcomes these drawbacks.

BRIEF DESCRIPTION

An apparatus is provided for concealing and dispensing of rolled sheet type material.

A preferred embodiment of the apparatus includes a body having a first end that includes a faceplate with an elongated slot therethrough, the faceplate configured to be mounted to (e.g., abut against) an associated planar surface having an associated opening therein that communicates with the elongated slot when the faceplate is mounted to the associated planar surface, the faceplate dimensioned to surround the associated opening. The body further includes a second end having a reduced perimeter dimension relative to the faceplate wherein the reduced perimeter dimension is configured for receipt in the associated opening of the associated planar surface. An L-shaped mounting member or support has a first region or portion extending from the body and a second region or portion extending substantially perpendicular to the first portion, the second portion forming a spindle configured to receive an associated roll of sheet type material whereby a terminal end of the associated sheet material is advantageously mounted adjacent to and fed through (i.e., passes through) the slot in the faceplate.

In one embodiment, a fastener portion is operatively associated with the body to secure the body to the associated planar surface. The fastener includes at least one tubular member having a saw-toothed perimeter surface that cooperates with an associated fastener receiving opening in the associated planar surface.

The tubular member is preferably held in place in a planar surface by associated fasteners.

The L-shaped mounting member is configured in one embodiment to be selectively attached to the body.

The spindle is configured to receive a roll of sheet material thereon, particularly an elongated central through opening of the annular roll is received over the spindle.

In another embodiment, the spindle is adjustable in length in order to receive different sizes or lengths of sheet material rolls.

In still another embodiment, at least a portion of the opening in the faceplate of the body includes a serrated edge to prevent the associated sheet material from retracting rearwardly from the faceplate opening, and/or to assist with separating portions of the sheet material from the remainder of the sheet.

In yet another embodiment, the fastener portion of the assembly includes a retainer clip (e.g., preferably metal) that includes retaining tab(s) that extend inwardly into an elongated opening in the retaining clip. The elongated opening in the retainer clip is dimensioned for sliding receipt over an external portion of the body that is located rearwardly of the faceplate. The retaining tab(s) grippingly engage an outer surface portion of the external portion of the body such that when the retainer clip is advanced over the external portion of the body and snugly abuts against a planar surface such as an inner face of the associated cabinet, the retainer clip thus fastens the body to the cabinet.

A separate tool is preferably provided to assist with initial feeding of a terminal portion of the sheet material through the cabinet via the body opening. In a preferred embodiment, the tool includes an enlarged planar or paddle-shaped region having an elongated, transverse slot extending inwardly from an edge thereof that receives the terminal end of the associated sheet product. Once the terminal end of the sheet product is temporarily held in the tool slot, the tool is pulled away from the roll or spindle and initially feeds the sheet product through the body opening.

In one embodiment, the mounting member has a non-round cross-sectional configuration.

The body is preferably formed from one of a polymer, metal, or wood, or combinations thereof.

A primary advantage relates to concealment of a rolled good or product, and/or at least partial concealment of the dispenser itself.

Another benefit resides in the accessibility of the rolled product, particularly when concealing the rolled product and at least part of the dispenser.

A further advantage is realized through the space savings (e.g., wall, floor, or countertop space) associated with a paper roll dispensing apparatus that is at least partially concealed.

A still further benefit is associated with creating a seamless looking, integral, hidden dispenser that complements the look of the cabinet/storage device while simultaneously taking advantage of unused, dormant space that is otherwise not utilized.

Yet another advantage relates to the ability to protect or shield sheet material product from potential damage that might otherwise occur with wall or countertop installations.

Still other benefits and advantages will become apparent to those skilled in the art upon reading and understanding the following detailed description.

DETAILED DESCRIPTION

Figure 1:
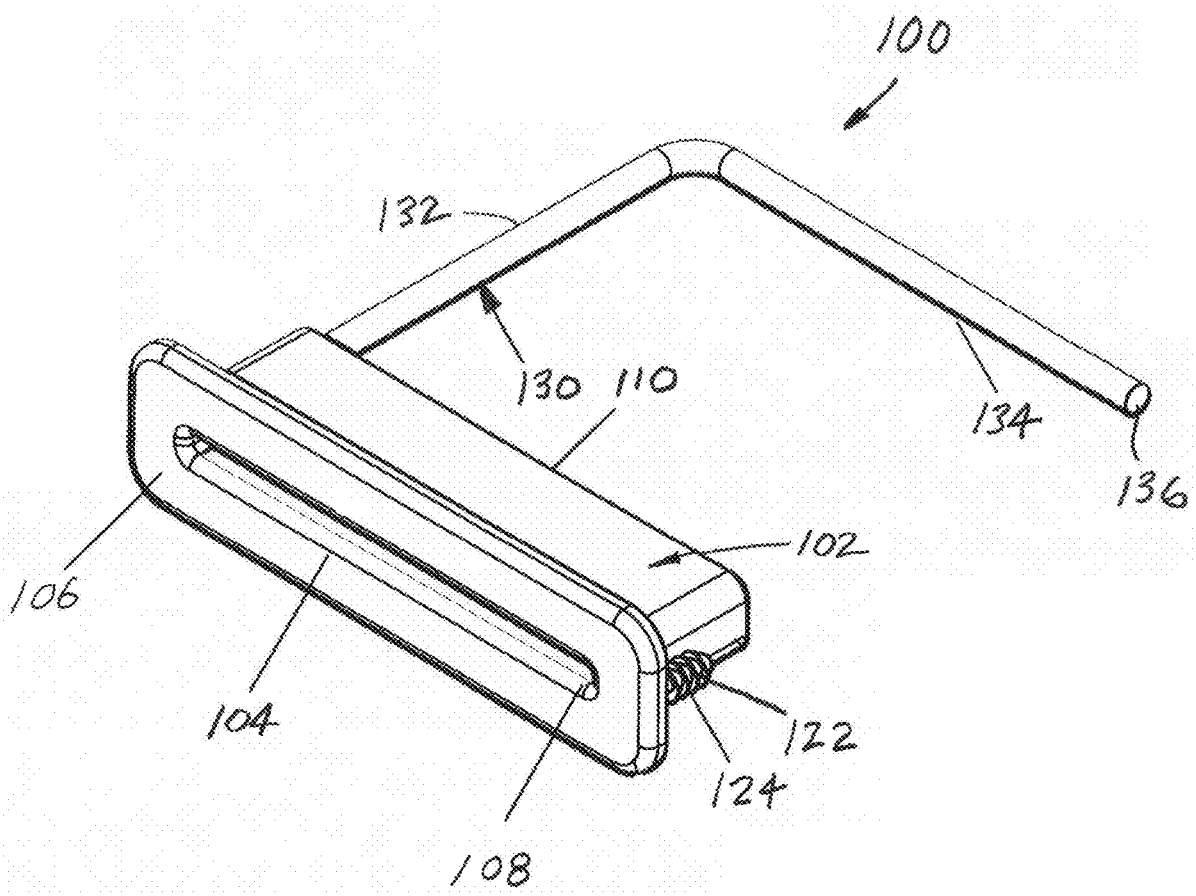
FIG. 1 is a perspective view of the apparatus taken generally from the front and right-hand side.
Figure 2:
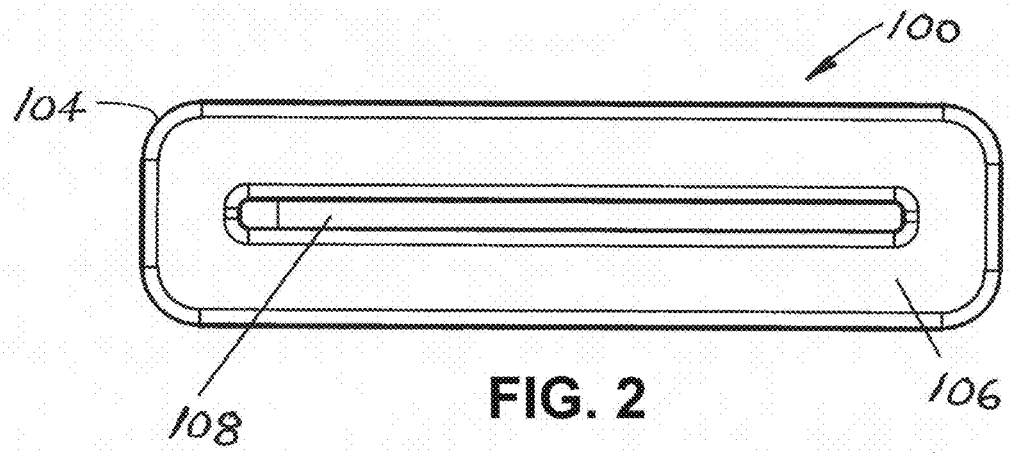
FIG. 2 is a front elevational view of the apparatus FIG. 1.
Figure 3:
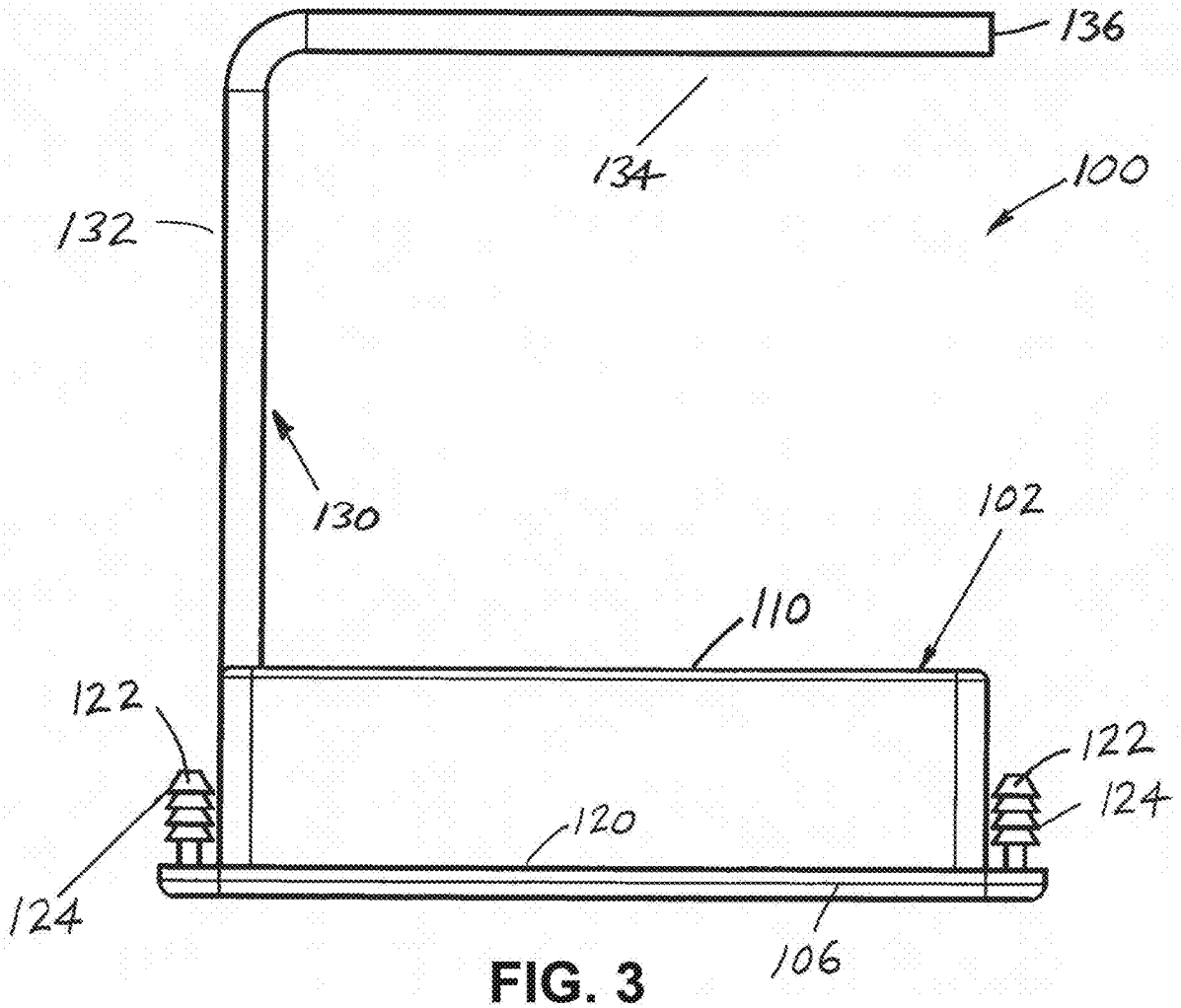
FIG. 3 is a top plan view of the apparatus of FIG. 1 and a bottom plan view (not shown) is a mirror image thereof.
Figure 4:
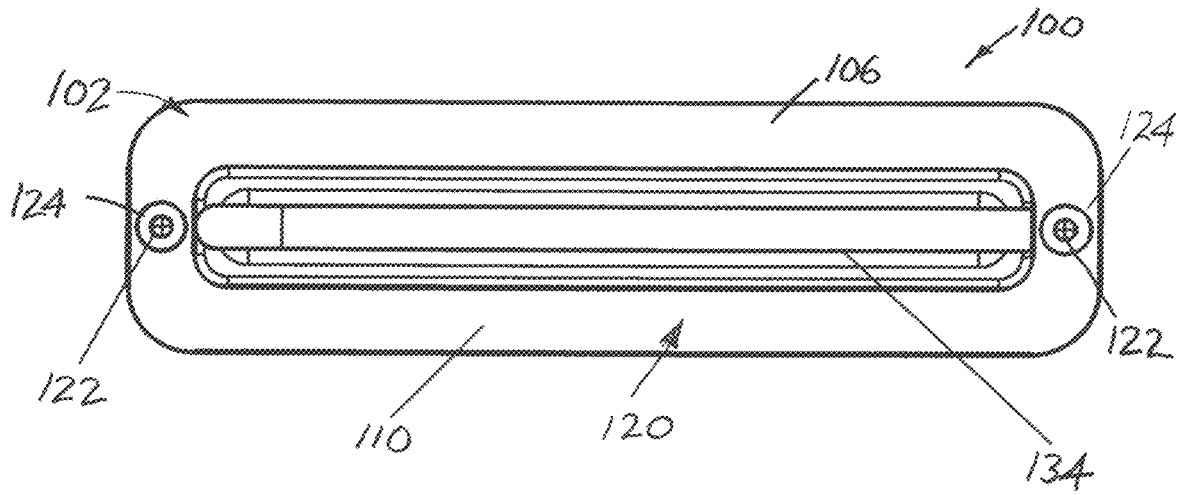
FIG. 4 is a rear elevational view of the apparatus of FIG. 1.
Figure 5:
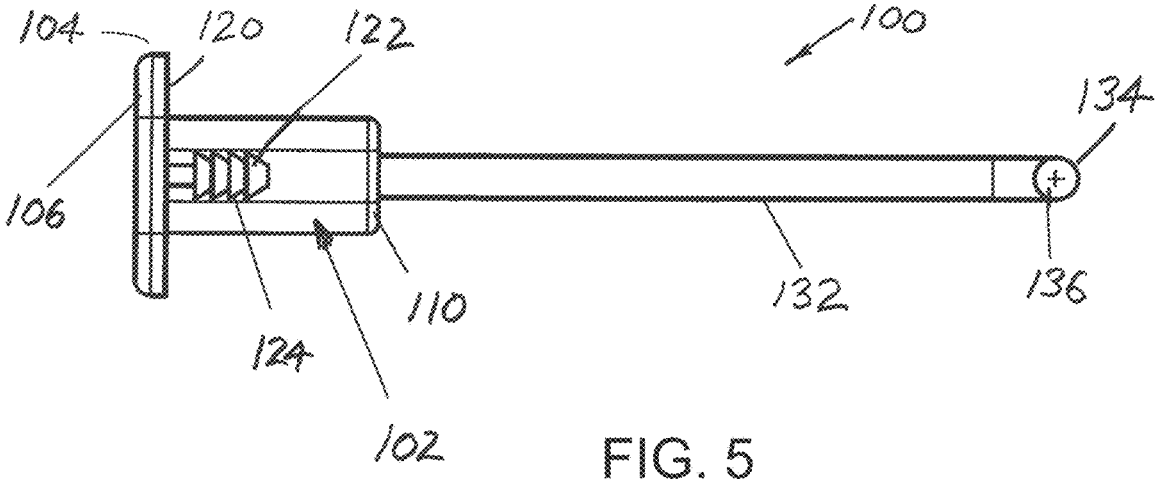
FIG. 5 is a side elevational view of the apparatus taken from the right-hand side of FIG. 1.
Figure 6:
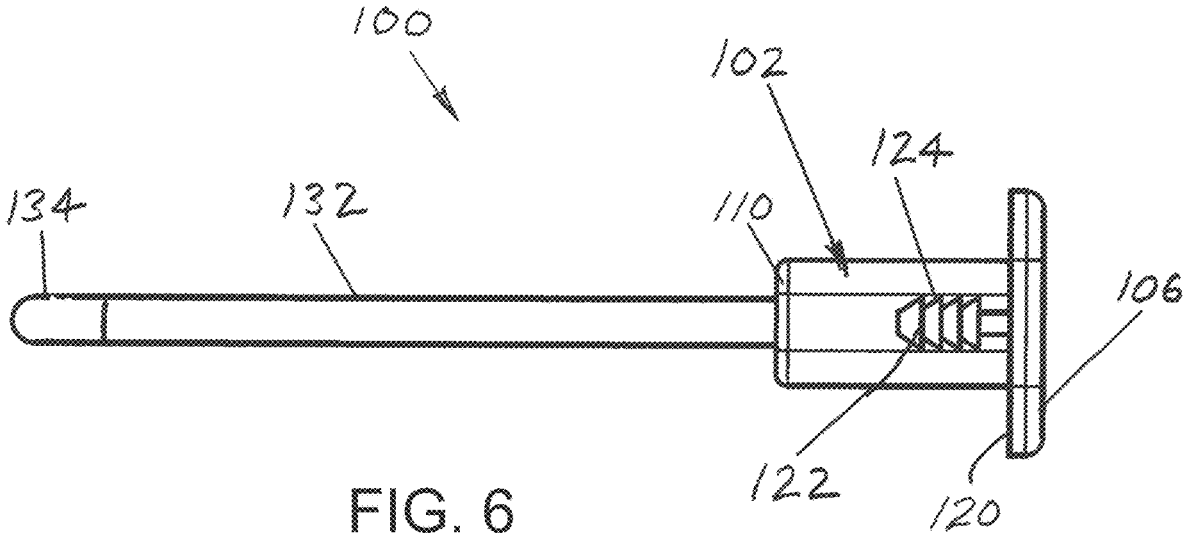
FIG. 6 is a side elevational view taken from the left-hand side of FIG. 1.

The following description with reference to the accompanying drawings is provided to assist in a comprehensive understanding of one or more embodiments of the present disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the present disclosure. Various exemplary embodiments of the present disclosure are not limited to the specific details of different embodiments and should be construed as including all changes and/or equivalents or substitutes included in the ideas and technological scope of the appended claims. In describing the drawings, where possible similar reference numerals are used for similar elements.

The terms "include" or "may include" used in the present disclosure indicate the presence of disclosed corresponding functions, operations, elements, and the like, and do not limit additional one or more functions, operations, elements, and the like. In addition, it should be understood that the terms "include", "including", "have" or "having" used in the present disclosure are to indicate the presence of components, features, numbers, steps, operations, elements, parts, or a combination thereof described in the specification, and do not preclude the presence or addition of one or more other features, numbers, steps, operations, elements, parts, or a combination thereof.

The terms "or" or "at least one of A or/and B" used in the present disclosure include any and all combinations of words enumerated with them. For example, "A or B" or "at least one of A or/and B" mean including A, including B, or including both A and B.

Although the terms such as "first" and "second" used in the present disclosure may modify various elements of the different exemplary embodiments, these terms do not limit the corresponding elements. For example, these terms do not limit an order and/or importance of the corresponding elements, nor do these terms preclude additional elements (e.g., second, third, etc.) The terms may be used to distinguish one element from another element. For example, a first mechanical device and a second mechanical device all indicate mechanical devices and may indicate different types of mechanical devices or the same type of mechanical device. For example, a first element may be named a second element without departing from the scope of the various exemplary embodiments of the present disclosure, and similarly, a second element may be named a first element.

It will be understood that, when an element is mentioned as being "connected" or "coupled" to another element, the element may be directly connected or coupled to another element, and there may be an intervening element between the element and another element. To the contrary, it will be understood that, when an element is mentioned as being "directly connected" or "directly coupled" to another element, there is no intervening element between the element and another element.

The terms used in the various exemplary embodiments of the present disclosure are for the purpose of describing specific exemplary embodiments only and are not intended to limit various exemplary embodiments of the present disclosure. As used herein, the singular forms are intended to include the plural forms as well, unless the context clearly indicates otherwise. Use of dimensions, temperatures, ranges, time, relationships (e.g., "perpendicular", "parallel"), etc. that either use or do not use further adjectives such as "generally", "substantially", "about" or "approximately" in the description or claims are intended to cover both the specific dimension, temperature, range, time, relationship, etc., as well as a range of equivalents (function, way, or result) and only intended to be limited by teachings of the prior art.

The terms used in the various exemplary embodiments of the present disclosure are for the purpose of describing specific exemplary embodiments only and are not intended to limit various exemplary embodiments of the present disclosure. As used herein, the singular forms are intended to include the plural forms as well, unless the context clearly indicates otherwise.

All of the terms used herein including technical or scientific terms have the same meanings as those generally understood by an ordinary skilled person in the related art unless they are defined otherwise. The terms defined in a generally used dictionary should be interpreted as having the same meanings as the contextual meanings of the relevant technology and should not be interpreted as having inconsistent or exaggerated meanings unless they are clearly defined in the various exemplary embodiments.

This written description uses examples to describe the disclosure, including the best mode, and also to enable any person skilled in the art to make and use the disclosure.

Other examples that occur to those skilled in the art are intended to be within the scope of the invention if they have structural elements that do not differ from the same concept or that do not differ from the literal language of the claims, or if they include equivalent structural elements with insubstantial differences from the same concept or from the literal language of the claims. Moreover, this disclosure is intended to seek protection for a combination of components and/or steps and a combination of claims as originally presented for examination, as well as seek potential protection for other combinations of components and/or steps and combinations of claims during prosecution.

Although specific advantages have been enumerated above, various embodiments may include some, none, or all of the enumerated advantages. Although exemplary embodiments are illustrated in the figures and description herein, the principles of the present disclosure may be implemented using any number of techniques, whether currently known or not. Moreover, the operations of the systems and apparatuses disclosed herein may be performed by more, fewer, or other components, and the methods described herein may include more, fewer, or other steps. Additionally, steps may be performed in any suitable order.

To aid the Patent Office and any readers of this application and any resulting patent in interpreting the claims appended hereto, applicants do not intend any of the appended claims or claim elements to invoke 35 USC 112 (f) unless the words "means for" or "step for" are explicitly used in the particular claim.

With reference to FIGS. 1-7, an exemplary embodiment of an apparatus 100 for concealed dispensing of rolled sheet type material SM (FIG. 7) is shown. The apparatus 100 includes a body 102, preferably a one-piece construction although this is not a requirement. For example, the apparatus 100 can be made from plastic (polymer), metal, wood, as well as other durable materials. The body 102 includes a first or front end 104 having an enlarged dimension that forms a faceplate 106. The body 102 includes an elongated slot 108 that extends therethrough so that the slot is accessible through the faceplate 106.

Preferably, the faceplate 106 is a relatively thin, planar structure that is configured to mate with an associated mounting surface MS that includes an associated opening OP therethrough. The perimeter dimension of the faceplate 106 is greater than the associated opening OP so that the faceplate abuts against the associated mounting surface MS. On the other hand, the remainder of the body 102, and particularly a second or inner end 110, has a smaller peripheral dimension so that the second end of the body 102 is closely received through the associated opening OP. Perimeter edges of the body 102 and the slot 108 are preferably rounded or chamfered to provide a smooth surface that reduces the prospect of material catching thereon as will become more apparent below.

Extending from a rear face 120 of the face plate 106 is a fastener portion, and preferably a pair of fastener portions, 122. The fastener portions 122 in one preferred arrangement are generally tubular members having a saw-tooth perimeter surface 124. The saw-tooth surface 124 deforms or diametrically collapses when inserted through an associated fastener receiving opening in the mounting surface MS. That is, the second end 110 of the body 102 is aligned with the associated opening OP in the associated mounting surface MS, and the body is axially advanced relative to and through the associated opening. Continued advancement of the body 102 into the associated opening OP brings the fastener portions 122 into alignment with associated fastener receiving openings (not shown), and the saw-tooth surfaces 124 of the fastener portions reduce in diameter as the fastener portions are pushed into the fastener receiving openings. Once the saw-tooth surfaces 124 of the fastener portions pass through the fastener receiving openings, the sawtooth surfaces expand in diameter and prevent inadvertent removal of the apparatus 100 from the mounting surface MS.

Figure 7:
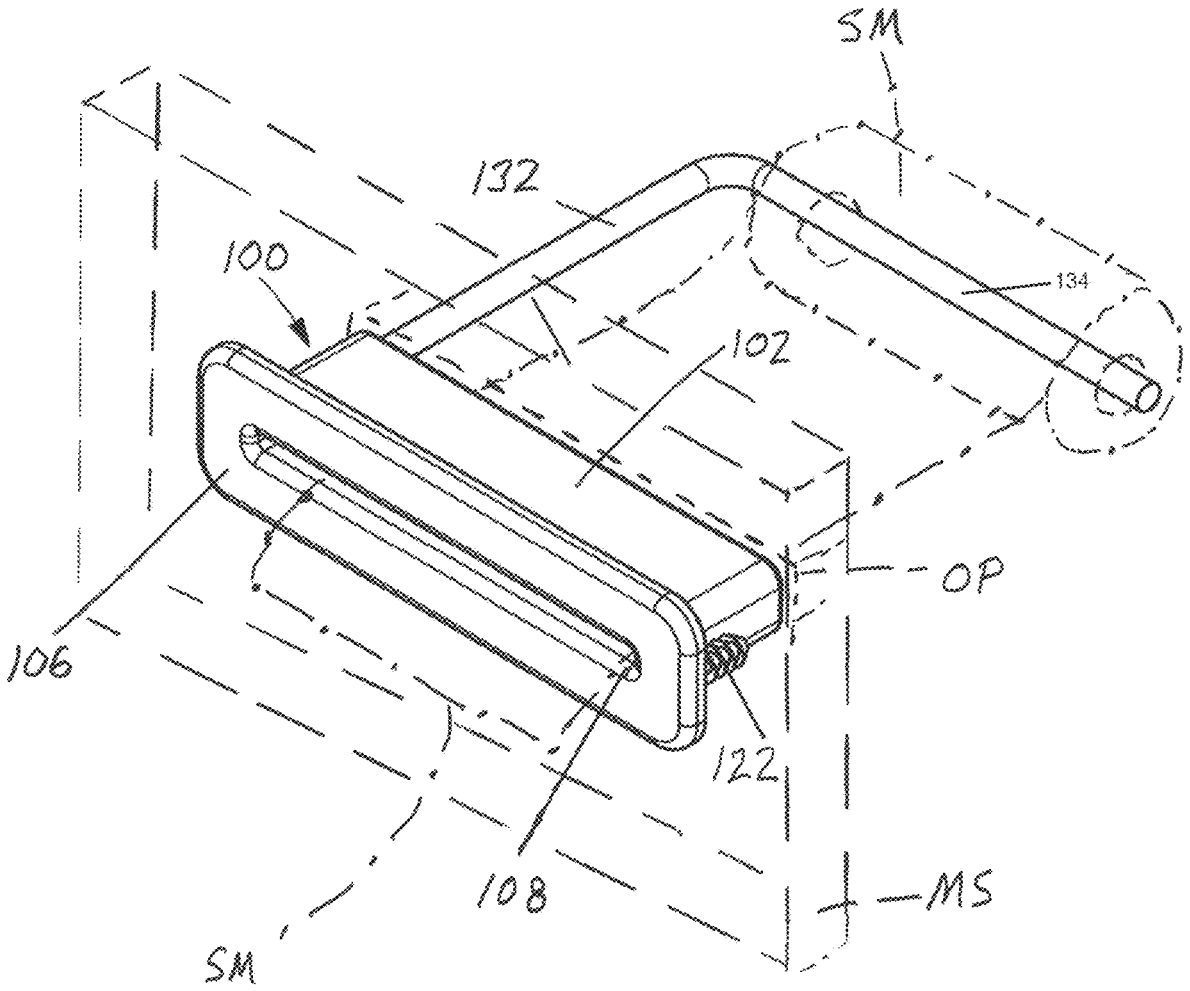
FIG. 7 is a perspective view of the apparatus with a supply of sheet material received thereon.
Figure 8:
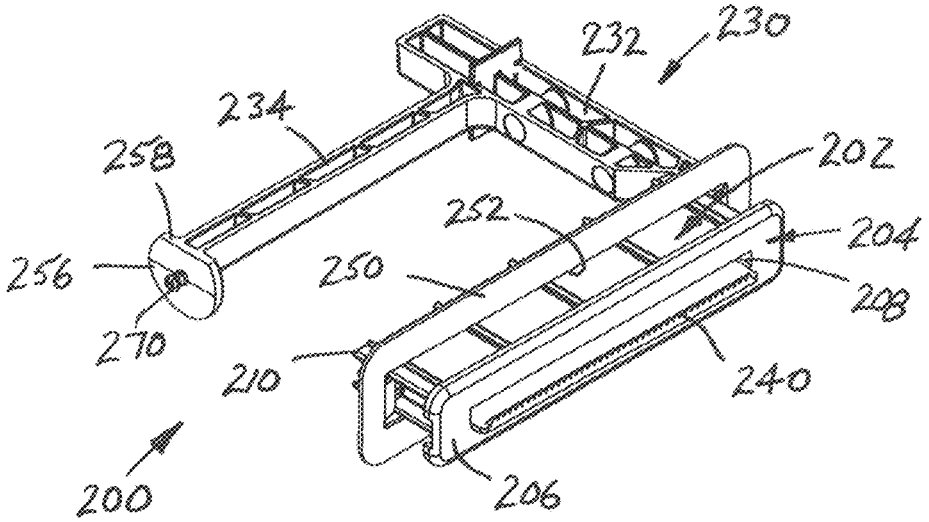
FIG. 8 is a perspective view of a second embodiment of the apparatus taken generally from the front and a left-hand side thereof.
Figure 9:
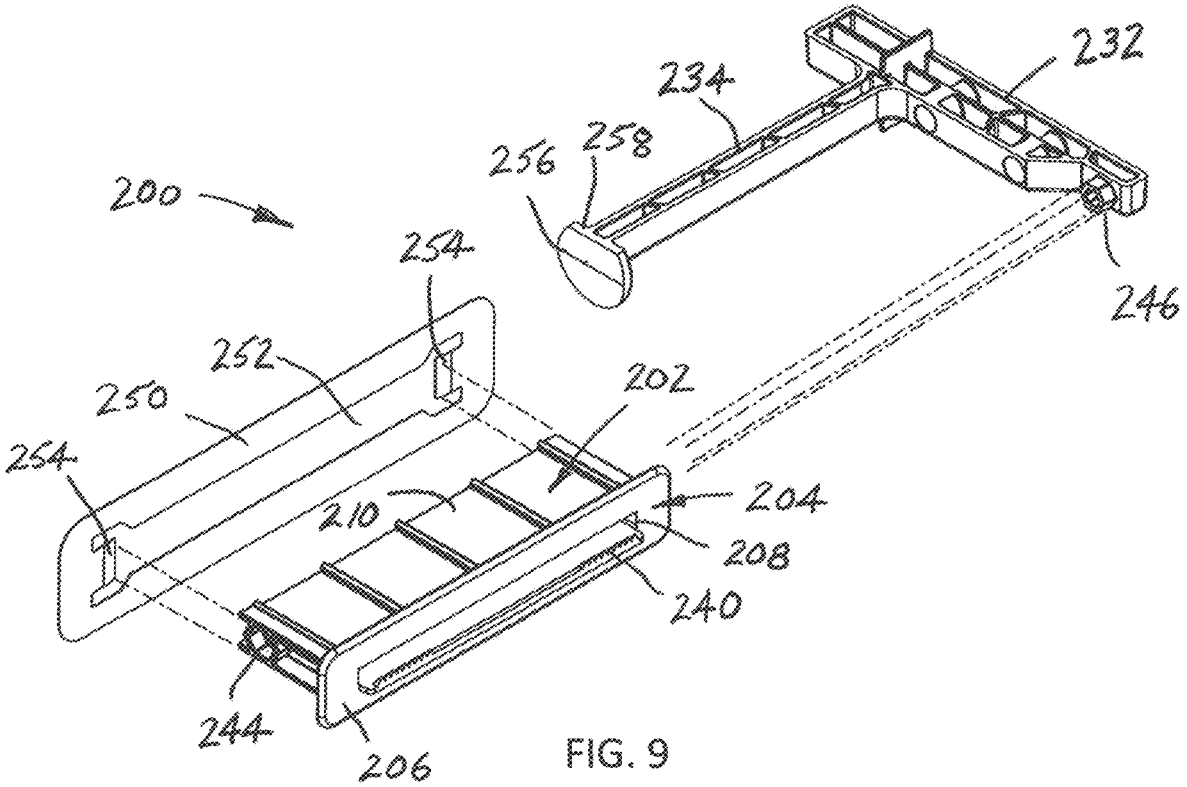
FIG. 9 is an exploded perspective view of the embodiment of FIG. 8.
Figure 10:
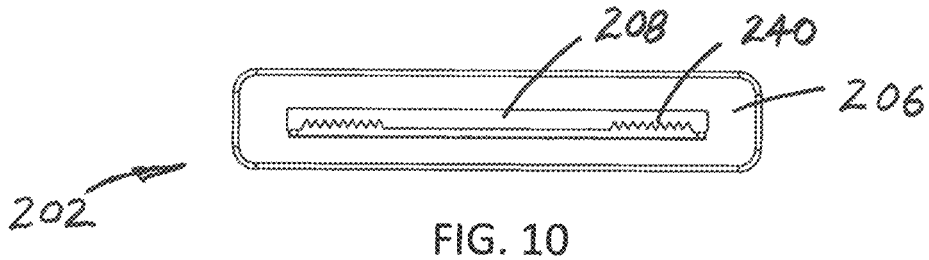
FIG. 10 is a front elevational view of the body of the embodiment of FIG. 8.
Figure 11:
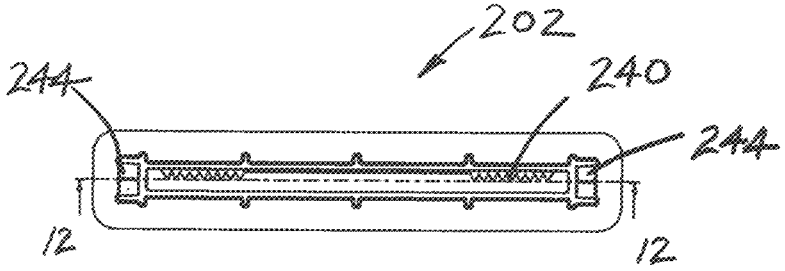
FIG. 11 is a rear elevational view of the body of FIG. 8.
Figure 12:
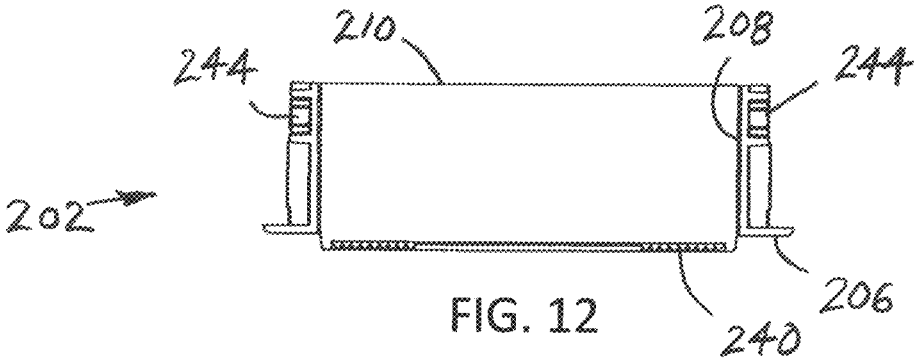
FIG. 12 is a cross-sectional view of the body taken generally along the lines 12-12 of FIG. 11.

An L-shaped mounting member 130 extends outwardly from the body 102. More particularly, the mounting member 130 includes a first portion 132 projecting axially outward from the side or rear face of the body 102. The first portion 132 of the mounting member 130 is preferably rod-shaped and is preferably cantilever mounted to the body. A second portion 134 of the mounting member 130 extends substantially perpendicular to the first portion 132, and thus is substantially parallel to the interior end 110 of the body 102. The mounting member second portion 134 preferably has a round outer surface and thereby forms a spindle on which a roll of sheet material SM is mounted. For example, the sheet material SM may be paper towels, toilet paper, wipes, etc. As best illustrated in FIG. 7, the associated sheet material SM is received over a terminal end 136 of the second portion/spindle 134. This allows the roll of sheet material SM to rotate relative to the spindle. Preferably, the terminal end 136 of the spindle 134 includes one or more protrusions or nubs that extending radially outward, for example, in circumferentially spaced locations that act as stop member or a stop surface that allow the roll of sheet material to pass over the protrusions; however, the protrusions also act to retain the associated roll of sheet material on the spindle. One skilled in the art will appreciate that the spindle could be oriented, i.e., mounted or installed vertically or horizontally, within an accessible concealed area such as a cabinet, etc., without departing from the scope and intent of the present invention.

At least one fastener portion 122 secures the apparatus on the associated planar mounting surface MS. The fastener portion(s) 122 may be held in place in the planar surface by friction. In yet another embodiment, the fastener portion(s) 122 may be held in place in the associated mounting surface MS by separate fasteners, e.g., screws.

Another modification provides a selectively detachable mounting member 130 and/or detachable spindle 134. Ultimately, the spindle 134 extends parallel to the rear of the faceplate 106 so that the associated sheet material SM can pass from the roll located on the spindle 134 and through the elongated slot 108 for access on the front face of the faceplate slot 108.

In different embodiments, the body 102 is made of a wood, plastic, metal, or any combination thereof in order to match existing surrounding materials and/or color, look, appearance, or decor.

For purposes of consistency and ease of understanding, the second embodiment of FIGS. 8-12, like components will be identified by like reference numerals in the "200" series. For example, the second embodiment refers to the apparatus 200, which bear similarities to the apparatus 100 of FIGS. 1-7. The apparatus 200 includes a body 202 having a first or front end 204 having an enlarged dimensioned to form faceplate 206 with an elongated slot 208 formed therein. The elongated slot 208 extends entirely through the body 202. A second or inner end 210 of the body 202 as a smaller peripheral dimension whereby the second end is closely received through the associated opening OP in an associated mounting surface MS (FIG. 7).

One notable difference in the body 202, and particularly in the elongated slot 208, is the addition of a serrated edge 240. The serrated edge 240 prevents sheet product from retracting backwardly through the elongated slot 208. In addition, the body 202 includes contoured recesses 244, e.g., hexagonal recesses, on opposite sides of the inner end 210 of the body. One of the two recesses 244 cooperate with a similarly shaped protrusion 246 associated with the L-shaped mounting member 230. Particularly, the similar shapes of the recesses 244, and the protrusion 246 provides for keyed receipt of one arm 232 of the mounting member 230. In the preferred arrangement of the second embodiment, the external configuration of protrusion 246 is hexagonally shaped which allows for fixed relative rotation of the mounting member 230 relative to the body 202. The mounting member 230 may be rotated through, for example, 30° increments relative to the body with a hex-shaped protrusion 246. This may be desirable depending on the contour and volume of the cavity or space behind the mounting surface MS, and consequently the ability to accommodate the associated roll of sheet material SM.

Additionally, a face plate, such as an annular rear face plate or retainer clip, 250 may also be provided and includes an opening 252 dimensioned for receipt over the inner end 210 of the body 202. In addition, engaging members such as first and second retaining tabs 254 (FIG. 9) extend inwardly into the opening 252 for engagement with the external surface of the body inner end 210.

Still another modification evident in the second embodiment is a second portion or spindle arm 234 that extends substantially perpendicular to the first arm 232 includes an enlarged flange 256. Specifically, the end of the spindle arm 234 spaced from the first arm 232 includes the flange 256. The flange 256 is dimensioned for receipt in an annular tube or core of the sheet material roll SM. A flat edge 258 of the flange 256 allows the roll of sheet material SM to be received thereover, and ultimately supported on the spindle arm 234 between the flange and the support arm 232. The flange serves to abuttingly engage one end of the roll sheet material SM.

Figure 13:
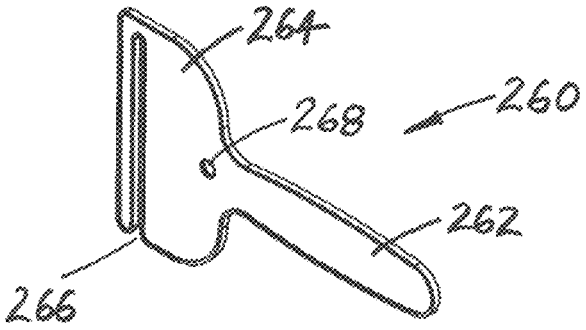
FIG. 13 is a perspective view of a tool used to grasp the sheet material.
Figure 14:
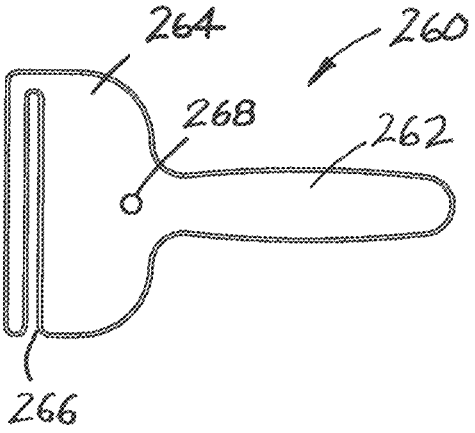
FIG. 14 is a top plan view of the tool of FIG. 13.

FIGS. 13 and 14 illustrate a tool 260 particularly useful for initial and subsequent feed of the sheet material through slot 108/208 in the body. The tool 260 includes a handle portion 262 and an enlarged head or planar portion 264 that includes an elongated transverse slot 266 that extends inwardly from one side of the head and terminates in the enlarged head before reaching the opposite side thereof. The head 264 of the tool 260 is preferably dimensioned for receipt in the elongated slot 108/208 of the body. A terminal end of the sheet material SM is received in the transverse slot 266 of the tool 260 and a user can then pull outwardly on handle 262 to remove the tool from the slot 108 of the body, and pull a leading end of the sheet material outwardly through elongated slot. It is also contemplated that the tool 260 may include an attachment feature such as opening 268. The opening 268 is dimensioned for receipt over pin 270 (FIG. 8) that extends outwardly from the flange 256. Of course the opening 268 and the pin 270 may be positioned at other locations on the tool 260 and apparatus 200, respectively, and still effectively serve to temporarily mount the tool to the apparatus when the tool is not in use.

Figure 15:
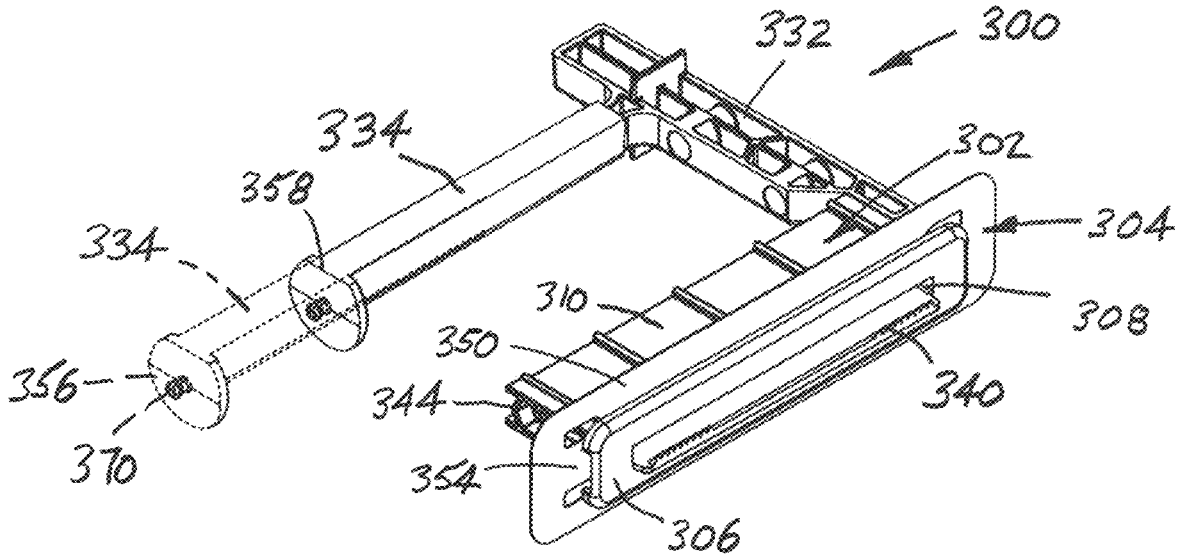
FIG. 15 is a perspective view of a third embodiment of the apparatus taken generally from the front and a left-hand side thereof.
Figure 16:
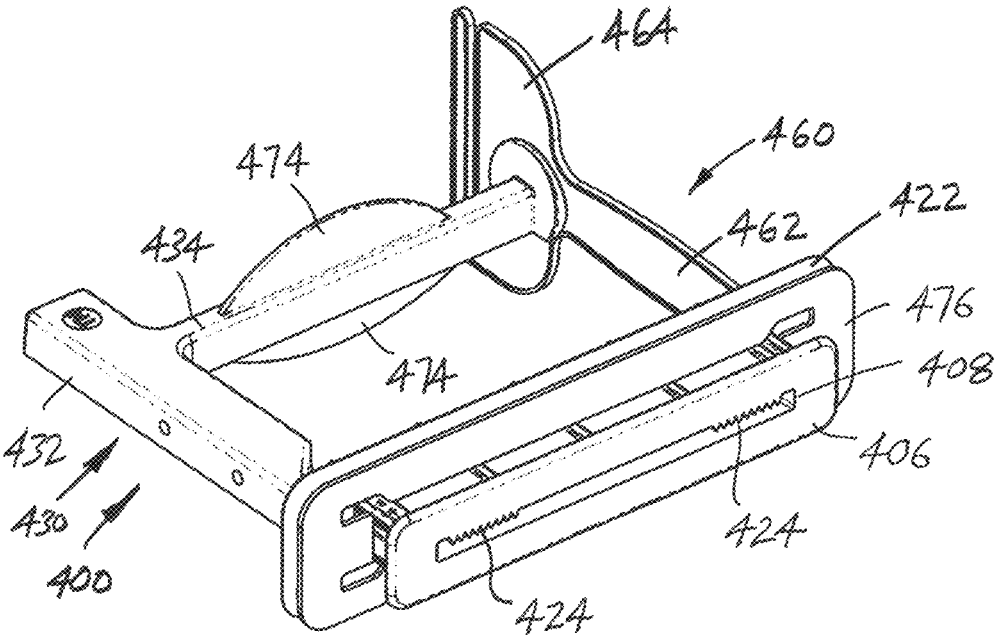
FIG. 16 is a perspective view of another embodiment of the apparatus taken generally from the front and left-hand side.
Figure 17:
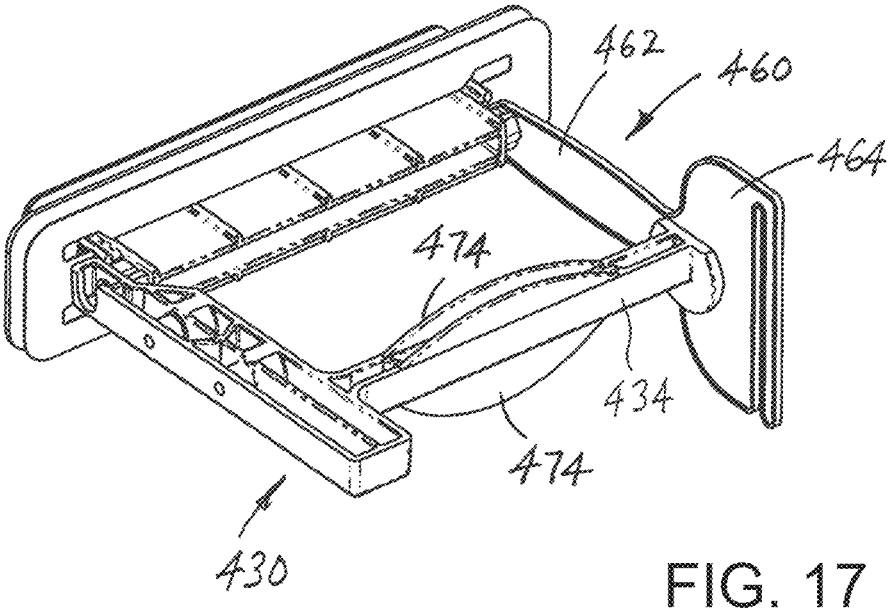
FIG. 17 is a perspective view of the embodiment of FIG. 16 taken generally from the rear and the right-side thereof.
Figure 18:
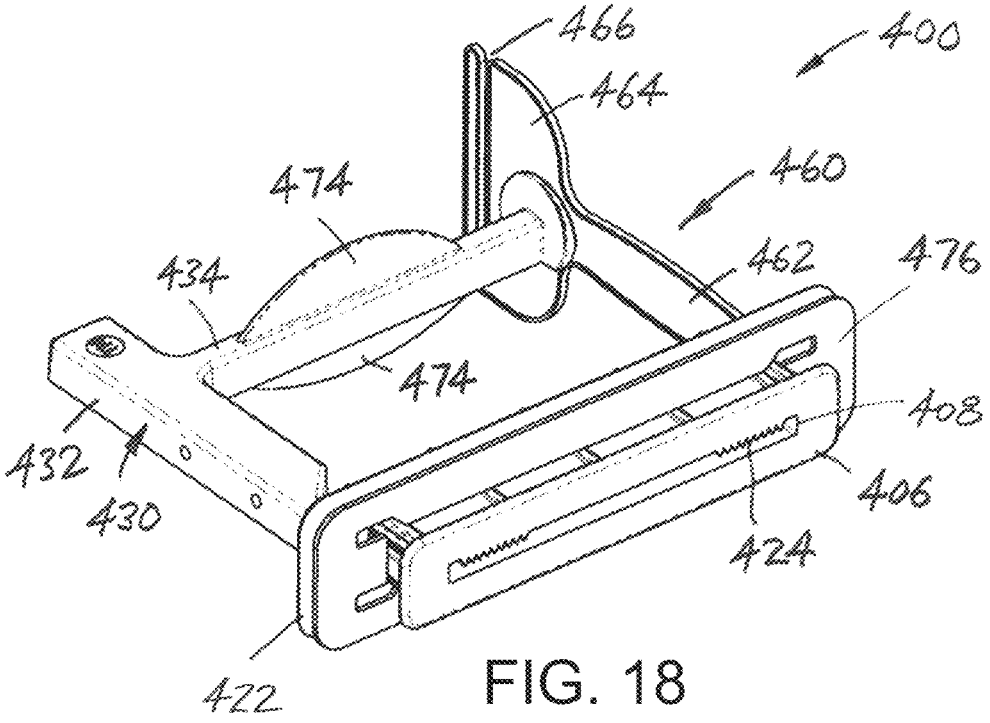
FIG. 18 is a perspective view of still another modification of the apparatus taken generally from the front and left-hand side.
Figure 19:
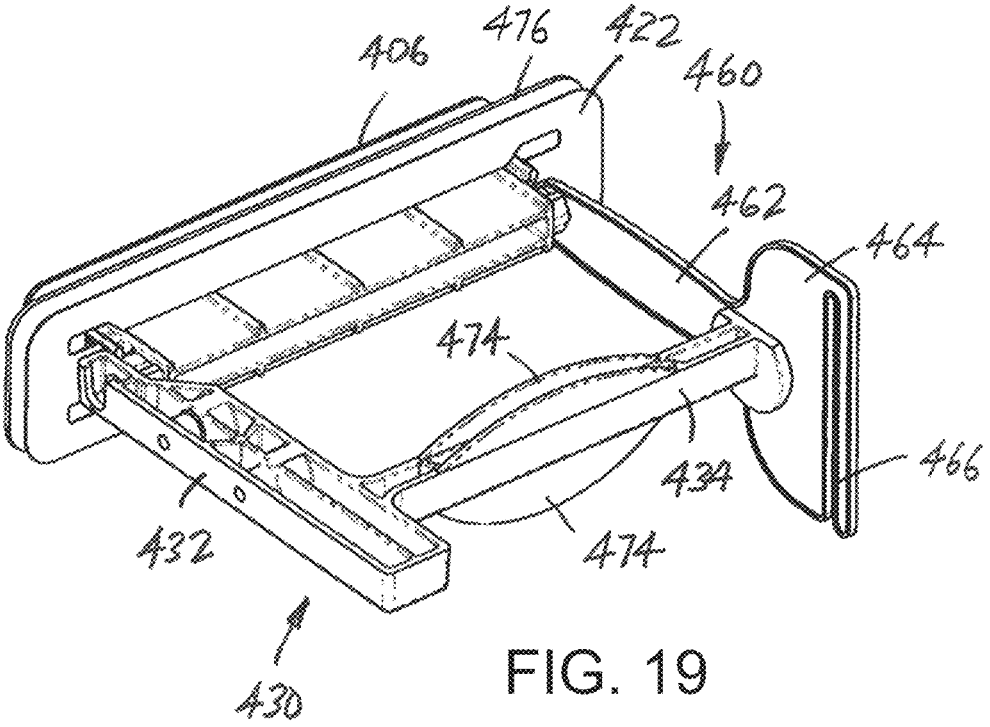
FIG. 19 is a perspective view of the embodiment of FIG. 18 taken generally from the rear and the right-side thereof.
Figure 20:
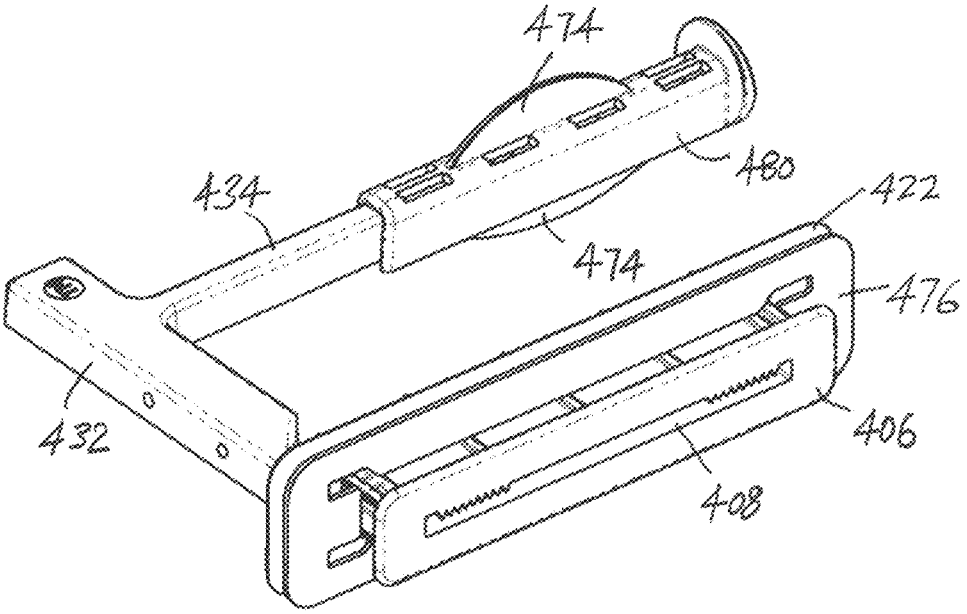
FIG. 20 illustrates still further variations of the apparatus in a perspective view taken generally from the front and left-side thereof.
Figure 21:
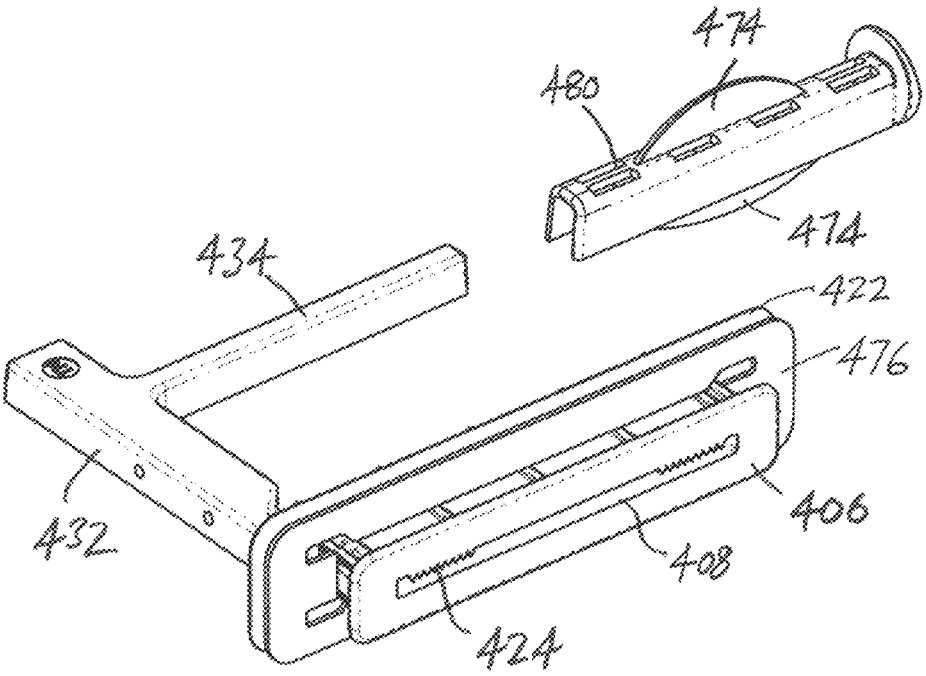
FIG. 21 is an exploded perspective view of the variation of FIG. 20.
Figure 22:
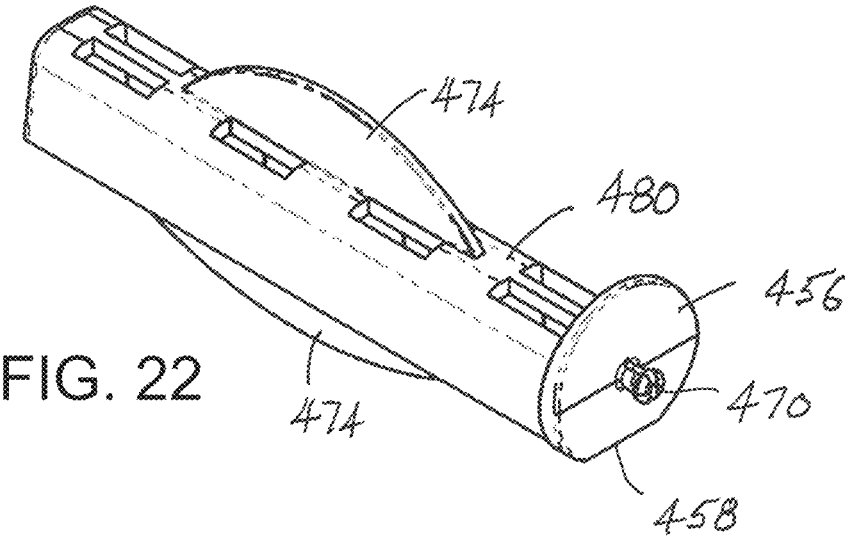
FIG. 22 is an enlarged perspective of an outer adjustable arm portion such as used in the version of FIGS. 20-21.
Figure 23:
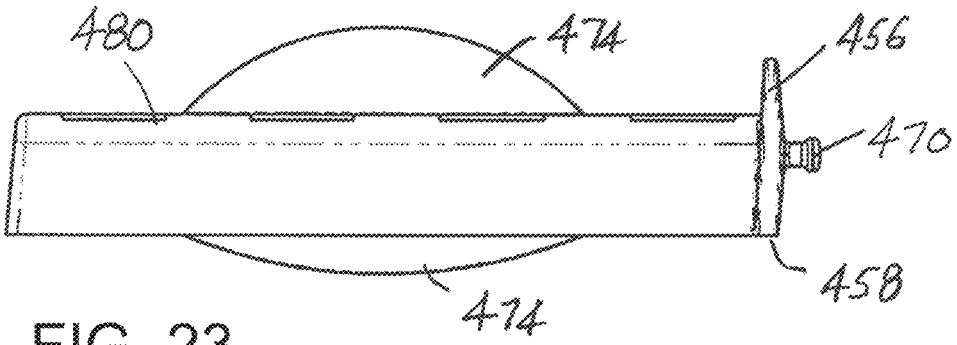
FIG. 23 is a front elevational view of the adjustable arm portion of FIG. 22.
Figure 24:
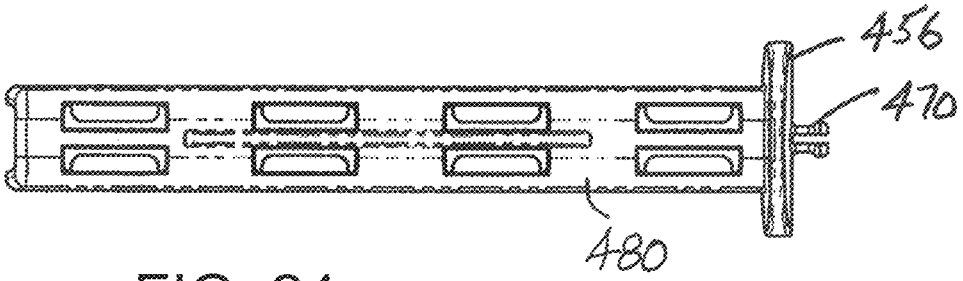
FIG. 24 is a top plan view of the adjustable arm portion of FIGS. 22-23.

FIG. 15 illustrates a third embodiment of the apparatus identified reference numeral 300. The primary difference in this modified version of this second embodiment 300 is that spindle arm 334 has an adjustable length as shown by the solid and broken line representations of FIG. 15. As desired, the spindle arm 334 may be shortened or lengthened as needed to accommodate different lengths of sheet material SM that may be received over the spindle arm.

Further variations of the apparatus 100, 200, or 300 are shown in FIGS. 16-24 and identified by reference numerals in the 400 series, e.g., apparatus 400 includes a body 402 having a first or front end 44 and a faceplate 406. Slot 408 is provided in the faceplate 406 and is dimensioned to receive sheet product (not shown) therethrough. Particularly, the sheet product is fed through a rear face 420 of the faceplate 406 and serrated teeth or sawtooth surface 424 facilitates separation of the sheet product. Here, the teeth 424 are in line with a front edge of the faceplate 406 to reduce the potential for the teeth to protrude outwardly from the faceplate, while still remaining effective at engaging the sheet product in order to initiate tearing or separation of the sheet product.

Enlarged protrusions or wing extensions 474 are also advantageously provided along the spindle 434 of the mounting member 430 (which is also shown to be preferably an L-shaped member). The protrusions/extensions 474 are preferably disposed on either side of the spindle in order to keep the sheet product centered while the spool of sheet product is rotated during use.

Still another variation is the inclusion of a spacer such as an annular foam spacer 476 that is preferably located between the rear of the cabinet door and the spring clip 450. By using a foamed material or other similar compressible material, sufficient tension can be established between the rear face of the cabinet door and the faceplate to hold the individual components of the assembly in place.

As particularly shown in FIGS. 16-19, the tool 460 is advantageously secured to the apparatus 400. As shown, a head portion 464 includes an opening dimension for snap-fit on mounting pin (not shown but akin to mounting pin 270 in FIG. 8) that extends outwardly from the enlarged flange 456. Further, the handle portion 462 of the tool 460 is contoured for engagement with the body 402. This allows the tool 460 to be easily stored on the mounting arm 430 when not in use.

FIGS. 20-24 illustrate yet another variation in which the wing portions 474 are provided on a separate, u-shaped adjustable arm 480 contoured and dimensioned for receipt over the second portion or spindle 434 of the mounting arm 430. In this manner, and as perhaps best evident in FIGS. 20 and 21, the adjustable arm 480 can be slid over the spindle 434. The first portion of 432 may be secured to an interior, mounting surface of a door or cabinet frame while the remainder of the body 402 can be positioned offset relative to that door/cabinet frame mounting surface. Because the u-shaped arm 480 can be adjusted along the spindle 434, proper alignment of the sheet product on the mounting arm 434 can still be arranged relative to the faceplate slot 408.

It should be clear that an apparatus for concealed dispensing of rolled sheet type material SM has been provided which is especially useful in saving space. However, the present invention is not to be construed as being limited to the form shown which is to be considered illustrative rather than restrictive. It will be appreciated that modifications and alternatives may be combined into many other different systems. It is intended that the exemplary embodiment be construed as including all such modifications and alterations insofar as they come within the scope of the appended claims or the equivalents thereof. Also, various presently unforeseen or unanticipated alternatives, modifications, variations, or improvements that may be subsequently made by those skilled in the art are intended to be encompassed by the following claims.

We claim:

1. An apparatus that stores and provides concealed dispensing of rolled type sheet material, the apparatus comprising:

a body having a first end that includes a faceplate with an elongated slot therethrough, the faceplate configured to be mounted to an associated planar surface having an associated opening therein that communicates with the elongated slot when the faceplate is mounted to the associated planar surface, and the faceplate is dimensioned to surround the associated opening; the body further including a second end having a reduced perimeter dimension relative to a perimeter dimension of the faceplate wherein the reduced perimeter dimension of the second end of the body is configured for receipt in the associated opening;

a fastener portion operatively associated with the body to secure the body to the associated planar surface; and an L-shaped mounting member having a first portion extending from the body and a second portion extending substantially perpendicular to the first portion, the second portion forming a spindle configured to receive an associated roll of sheet type material whereby the associated sheet material passes through the slot in the faceplate;

said L-shaped mounting member is configured to be selectively detached from the body, and the mounting member and the body are configured for selective connection in multiple different predetermined angular mounting positions relative to one another to adjust the angular position of the L-shaped mounting member relative to said body;

wherein said second end of said body and said first portion of said L-shaped mounting member comprising respective contoured structures that selectively mate with each other in a non-rotatable keyed manner at each of said predetermined angular positions.

2. The apparatus of claim 1 wherein the fastener includes at least one tubular member having a saw-toothed perimeter surface that cooperates with an associated fastener receiving opening in the associated planar surface.

3. The apparatus of claim 2, wherein the tubular member is held in place in a planar surface by associated fasteners.

4. The apparatus of claim 1, wherein the L-shaped mounting member has a non-round cross-sectional configuration.

5. The apparatus of claim 1, wherein the body is formed from one of a polymer, metal, or wood.

6. The apparatus of claim 1, wherein the spindle is configured for selective extension and retraction relative to the first portion of the L-shaped mounting member to accommodate different lengths of associated sheet material.

7. The apparatus of claim 1, wherein the elongated slot of the body includes a serrated edge to facilitate gripping of the associated sheet material.

8. The apparatus of claim 1, wherein the respective contoured structures of the second end of said body and the first portion of said L-shaped mounting member comprise a contoured recess and a contoured protrusion.

9. The apparatus of claim 8, wherein said contoured recess and said contoured protrusion comprise respective hexagonal structures.

10. The apparatus of claim 8, wherein said contoured structure of the second end of said body comprises respective contoured structures located on opposite sides of the second end of the body.

11. The apparatus of claim 10, wherein the respective contoured structures located on opposite sides of the second end of the body each comprises a hexagonal shape.

12. An apparatus that stores and provides concealed dispensing of rolled type sheet material, the apparatus comprising:

a body having a first end that includes a faceplate with an elongated slot therethrough, the faceplate configured to be mounted to an associated planar surface having an associated opening therein that communicates with the elongated slot when the faceplate is mounted to the associated planar surface, and the faceplate is dimensioned to surround the associated opening; the body further including a second end having a reduced perimeter dimension relative to a perimeter dimension of the faceplate wherein the reduced perimeter dimension of the second end of the body is configured for receipt in the associated opening;

a fastener portion operatively associated with the body to secure the body to the associated planar surface; and an L-shaped mounting member having a first portion extending from the body and a second portion extending substantially perpendicular to the first portion, the second portion forming a spindle configured to receive an associated roll of sheet type material whereby the associated sheet material passes through the slot in the faceplate;

wherein the fastener portion comprises a retainer clip including an opening received over the second end of the body, said retainer clip including retaining tabs that extend inwardly into the opening of the retaining clip, wherein the retaining tabs grippingly engage an outer surface portion of the second end of the body such that when the retainer clip is advanced over the second end of the body, the retainer clip fastens the body to the associated planar surface.

13. The apparatus of claim 12 wherein the L-shaped mounting member is configured to be selectively detached from the body.

14. An apparatus that stores and provides concealed dispensing of rolled type sheet material, the apparatus comprising:

a body having a first end that includes a faceplate with an elongated slot therethrough, the faceplate configured to be mounted to an associated planar surface having an associated opening therein that communicates with the elongated slot when the faceplate is mounted to the associated planar surface, and the faceplate is dimensioned to surround the associated opening; the body further including a second end having a reduced perimeter dimension relative to a perimeter dimension of the faceplate wherein the reduced perimeter dimension of the second end of the body is configured for receipt in the associated opening;

a fastener portion operatively associated with the body to secure the body to the associated planar surface; and an L-shaped mounting member having a first portion extending from the body and a second portion extending substantially perpendicular to the first portion, the second portion forming a spindle configured to receive an associated roll of sheet type material whereby the associated sheet material passes through the slot in the faceplate; and a tool including a head having a transverse slot therein dimensioned for receipt through the elongated slot of the body, and the transverse slot adapted to engage the associated sheet material.

* * * * *